US010301776B2

(12) United States Patent
Kumaki et al.

(10) Patent No.: US 10,301,776 B2
(45) Date of Patent: May 28, 2019

(54) GREASEPROOF PAPER HAVING EXCELLENT FOLDING RESISTANCE

(71) Applicant: KURARAY CO., LTD., Kurashiki-shi (JP)

(72) Inventors: Yosuke Kumaki, Kurashiki (JP); Masako Kawagoe, Kyoto (JP)

(73) Assignee: KURARAY CO., LTD., Kurashiki-shi (JP)

( * ) Notice: Subject to any disclaimer, the term of this patent is extended or adjusted under 35 U.S.C. 154(b) by 162 days.

(21) Appl. No.: 14/426,016

(22) PCT Filed: Sep. 2, 2013

(86) PCT No.: PCT/JP2013/073556
§ 371 (c)(1),
(2) Date: Mar. 4, 2015

(87) PCT Pub. No.: WO2014/038516
PCT Pub. Date: Mar. 13, 2014

(65) Prior Publication Data

US 2015/0259856 A1 Sep. 17, 2015

(30) Foreign Application Priority Data

Sep. 4, 2012 (JP) ..... 2012-194024

(51) Int. Cl.

| | |
|---|---|
| ***D21H 19/12*** | (2006.01) |
| ***D21H 27/10*** | (2006.01) |
| ***D21H 17/34*** | (2006.01) |
| ***D21H 17/35*** | (2006.01) |
| ***D21H 17/36*** | (2006.01) |
| ***D21H 19/10*** | (2006.01) |
| ***D21H 19/20*** | (2006.01) |
| ***D21H 21/16*** | (2006.01) |

(52) U.S. Cl.
CPC ..... *D21H 19/12* (2013.01); *D21H 17/34* (2013.01); *D21H 17/35* (2013.01); *D21H 17/36* (2013.01); *D21H 19/10* (2013.01); *D21H 19/20* (2013.01); *D21H 21/16* (2013.01); *D21H 27/10* (2013.01); *Y10T 428/31906* (2015.04)

(58) Field of Classification Search
None
See application file for complete search history.

(56) References Cited

U.S. PATENT DOCUMENTS

| | | | | |
|---|---|---|---|---|
| 5,536,304 | A * | 7/1996 | Coppens | C08K 5/5435 106/287.13 |
| 5,885,720 | A * | 3/1999 | Fujiwara | D21H 19/12 428/511 |
| 2004/0005341 | A1* | 1/2004 | Dixit | C08L 29/04 424/401 |
| 2007/0087190 | A1 | 4/2007 | Akiyama et al. | |
| 2007/0092718 | A1* | 4/2007 | Murphy | C09D 129/04 428/341 |
| 2008/0268240 | A1 | 10/2008 | Akiyama | |
| 2009/0149593 | A1* | 6/2009 | Funabiki | C08L 23/0861 524/442 |
| 2010/0112226 | A1 | 5/2010 | Weilbacher et al. | |

FOREIGN PATENT DOCUMENTS

| | | | |
|---|---|---|---|
| EP | 0 799 711 | A1 | 10/1997 |
| JP | 09-277461 | A | 10/1997 |
| JP | 2001-254292 | A | 9/2001 |
| JP | 2004-068180 | A | 3/2004 |
| JP | 2006-219786 | A | 8/2006 |
| JP | 2010-013792 | A | 1/2010 |
| JP | 2010-084245 | A | 4/2010 |
| JP | 2010-275647 | A | 12/2010 |
| JP | 2011-153385 | A | 8/2011 |

OTHER PUBLICATIONS

Extended European Search Report dated Mar. 31, 2016 in Patent Application No. 13835814.8.
International Search Report dated Oct. 29, 2013 in PCT/JP2013/073556 Filed Sep. 2, 2013.

* cited by examiner

*Primary Examiner* — Chinessa T. Golden
(74) *Attorney, Agent, or Firm* — Oblon, McClelland, Maier & Neustadt, L.L.P.

(57) ABSTRACT

Provided is greaseproof paper that, when folded, shows little reduction in grease resistance at the folded portion. The greaseproof paper includes a paper base and a greaseproof layer provided on at least one surface of the paper base, wherein the greaseproof layer includes an ethylene-vinyl alcohol-vinyl ester copolymer (A) and a fatty acid derivative (B), contains 1 to 100 parts by mass of the component (B) per 100 parts by mass of the component (A), and is in an amount of 0.5 to 5.0 g/m$^2$ in terms of dry mass. In the greaseproof paper, the ethylene-vinyl alcohol-vinyl ester copolymer (A) has a content of ethylene units of 1 to 15 mol %, has a total content of vinyl alcohol units and vinyl ester units of 85 to 99 mol %, and has a degree of polymerization of 300 to 2000. In the greaseproof paper, the fatty acid derivative (B) is a fatty acid amide compound.

4 Claims, No Drawings

GREASEPROOF PAPER HAVING EXCELLENT FOLDING RESISTANCE

TECHNICAL FIELD

The present invention relates to a greaseproof paper that has a greaseproof layer and that, when folded, shows little reduction in grease resistance at the folded portion.

BACKGROUND ART

According to JIS P 0001 "Paper, board and pulp—Vocabulary", greaseproof paper is defined as follows: 1) A general term for paper endowed with grease resistance; and 2) Paper or board having very high resistance to penetration of grease or fat.

In packaging materials for food products etc., greaseproof paper endowed with grease resistance is widely used. Particularly, for food products such as chocolates, pizzas, and donuts which contain large amount of grease or fat components, greaseproof paper is used so as to prevent grease from penetrating into the packaging materials. If grease or fat components contained in the food product penetrate into the packaging material, there is a possibility that grease penetrates up to the packaging material's surface that is not in contact with the food product, resulting in formation of grease stain which may deteriorate the appearance and thus commercial value of the product, may blacken a printed portion to make characters illegible, or may reduce the suitability of a barcode or the like for OCR. Since there is also the problem that grease is transferred to and smirches clothes, greaseproof paper is used which is endowed with grease resistance at a portion that comes into contact with a food product.

In order for greaseproof paper to exhibit grease resistance, fluorine compounds, particularly fluorinated compounds containing a perfluoro group, have been conventionally used. However, fluorinated compounds containing a perfluoro group have caused safety concerns because it has been revealed that when subjected to heating treatment, they produce substances that will accumulate in and do harm to human bodies. Under these circumstances, greaseproof paper has been proposed in which the surface of a paper base is coated with a fluorine-free greaseproof agent as an alternative to fluorine compounds.

It is known that vinyl alcohol polymers ("vinyl alcohol polymer" may be abbreviated as "PVA" hereinafter) can be used as fluorine-free greaseproof agents. PVAs are hydrophilic resins and form a strong film; therefore, they can prevent penetration of grease and are excellent in grease resistance. For example, Patent Literature 1 proposes greaseproof paper coated with a coating agent in which a PVA or a combination of a PVA and a crosslinking agent is used, and Patent Literature 2 proposes greaseproof paper coated with a coating agent containing starch and/or a PVA and a fatty acid. In either case, however, there is a problem in that grease resistance is significantly degraded and reduced particularly when the paper is folded.

CITATION LIST

Patent Literature

Patent Literature 1: JP 2004-68180 A
Patent Literature 2: JP 2006-219786 A

SUMMARY OF INVENTION

Technical Problem

The present invention aims to provide greaseproof paper that, when folded, shows little reduction in grease resistance at the folded portion.

Solution to Problem

As a result of diligent study, the present inventors have completed the present invention by finding that in the case where a greaseproof layer including an ethylene-vinyl alcohol-vinyl ester copolymer (A) and a fatty acid derivative (B) and containing 1 to 100 parts by mass of the component (B) per 100 parts by mass of the component (A) is provided on at least one surface of a paper base in an amount of 0.5 to 5.0 g/m$^2$ in terms of dry mass, the reduction in grease resistance when the resulting paper is folded is small at the folded portion.

That is, the present invention is greaseproof paper having the features presented below.

Greaseproof paper including a paper base and a greaseproof layer provided on at least one surface of the paper base, wherein the greaseproof layer includes an ethylene-vinyl alcohol-vinyl ester copolymer (A) and a fatty acid derivative (B), contains 1 to 100 parts by mass of the component (B) per 100 parts by mass of the component (A), and is in an amount of 0.5 to 5.0 g/m$^2$ in terms of dry mass.

The greaseproof paper, wherein the ethylene-vinyl alcohol-vinyl ester copolymer (A) has a content of ethylene units of 1 to 15 mol %, has a total content of vinyl alcohol units and vinyl ester units of 85 to 99 mol %, and has a degree of polymerization of 300 to 2000.

The greaseproof paper, wherein the fatty acid derivative (B) is a fatty acid amide compound.

Advantageous Effects of Invention

The greaseproof paper of the present invention can, when folded, maintain its grease resistance at the folded portion at a level that does not pose any problem in practical use; therefore, the present invention is useful for providing highly safe greaseproof paper suitable for practical use in packages or containers for various fried food products or fat-containing food products.

DESCRIPTION OF EMBODIMENTS

Hereinafter, the present invention will be described in detail.

In the ethylene-vinyl alcohol-vinyl ester copolymer used in the present invention, the content of ethylene units is preferably 0.1 to 15 mol %, more preferably 1 to 15 mol %, even more preferably 2 to 13 mol %, and particularly preferably 3 to 10 mol %. If the content of ethylene units is less than 0.1 mol %, the grease resistance of the coating layer will be reduced. If the content of ethylene units is more than 15 mol %, the solubility of the copolymer in water will be reduced, and coating of paper will be difficult.

In the ethylene-vinyl alcohol-vinyl ester copolymer used in the present invention, the total content of vinyl alcohol units and vinyl ester units is preferably 85 to 99 mol %. The content of vinyl alcohol units is preferably 84.9 to 99 mol %, more preferably 87 to 98 mol %, and particularly preferably 90 to 97 mol %. If the content of vinyl alcohol units is less than 84.9 mol %, the solubility of the copolymer in water will be reduced, and coating of paper will be difficult. If the content of vinyl alcohol units is more than 99 mol %, the grease resistance of the coating layer will be reduced. The content of vinyl ester units is preferably 0.1 to 15 mol % and more preferably 0.1 to 10 mol %.

The viscosity-average degree of polymerization (hereinafter abbreviated as degree of polymerization) of the ethylene-vinyl alcohol-vinyl ester copolymer used in the present invention is preferably 300 to 2000, more preferably 400 to 1800, and particularly preferably 500 to 1500. The degree of polymerization of the ethylene-vinyl alcohol-vinyl ester copolymer is measured according to JIS-K 6726. That is, the degree of polymerization can be determined by saponifying the ethylene-vinyl alcohol-vinyl ester copolymer again, purifying the saponified copolymer, and then calculating the degree of polymerization from the following formula using a limiting viscosity [η] measured in 30° C. water.

$$\text{Degree of polymerization}=([\eta]\times 10000/8.29)^{(1/0.62)}$$

If the degree of polymerization is less than 300, the surface strength of the greaseproof layer will be reduced. If the degree of polymerization is more than 2000, the viscosity of the aqueous solution of the coating agent will be too high, and the coating performance will be reduced.

The ethylene-vinyl alcohol-vinyl ester copolymer can be produced, for example, by polymerizing ethylene and a vinyl ester monomer by use of a conventionally-known method such as bulk polymerization, solution polymerization, suspension polymerization, emulsion polymerization, or dispersion polymerization, and saponifying the resulting ethylene-vinyl ester copolymer. Polymerization methods preferable from the industrial viewpoint are solution polymerization, emulsion polymerization, and dispersion polymerization. For the polymerization operation, any polymerization technique selected from batch polymerization, semibatch polymerization, and continuous polymerization can be used.

Examples of the vinyl ester monomer that can be used for polymerization include vinyl acetate, vinyl formate, vinyl propionate, vinyl caprylate, and vinyl versatate. Among these, vinyl acetate is preferable from the industrial viewpoint.

Another monomer may be allowed to participate in the copolymerization of the ethylene and the vinyl ester monomer without departing from the gist of the present invention. Examples of the other monomer that can be used include: α-olefins such as propylene, n-butene, and isobutylene; acrylic acid and salts thereof; acrylic acid esters such as methyl acrylate, ethyl acrylate, n-propyl acrylate, i-propyl acrylate, n-butyl acrylate, i-butyl acrylate, t-butyl acrylate, 2-ethylhexyl acrylate, dodecyl acrylate, and octadecyl acrylate; methacrylic acid and salts thereof; methacrylic acid esters such as methyl methacrylate, ethyl methacrylate, n-propyl methacrylate, i-propyl methacrylate, n-butyl methacrylate, i-butyl methacrylate, t-butyl methacrylate, 2-ethylhexyl methacrylate, dodecyl methacrylate, and octadecyl methacrylate; acrylamide; acrylamide derivatives such as N-methyl acrylamide, N-ethyl acrylamide, N,N-dimethylacrylamide, diacetone acrylamide, acrylamido-2-methylpropane sulfonic acid and salts thereof, acrylamidopropyldimethylamine and salts or quaternary salts thereof, and N-methylol acrylamide and derivatives thereof; methacrylamide; methacrylamide derivatives such as N-methylmethacrylamide, N-ethylmethacrylamide, methacrylamido-2-methylpropane sulfonic acid and salts thereof, methacrylamidopropyldimethylamine and salts or quaternary salts thereof, and N-methylol methacrylamide and derivatives thereof; vinyl ethers such as methyl vinyl ether, ethyl vinyl ether, n-propyl vinyl ether, i-propyl vinyl ether, n-butyl vinyl ether, i-butyl vinyl ether, t-butyl vinyl ether, dodecyl vinyl ether, and stearyl vinyl ether; nitriles such as acrylonitrile and methacrylonitrile; vinyl halides such as vinyl chloride and vinyl fluoride; vinylidene halides such as vinylidene chloride and vinylidene fluoride; allyl compounds such as allyl acetate and allyl chloride; unsaturated dicarboxylic acids such as maleic acid, itaconic acid, and fumaric acid, and salts or esters thereof; vinylsilyl compounds such as vinyltrimethoxysilane; and isopropenyl acetate.

In the copolymerization of the ethylene and the vinyl ester monomer, a chain transfer agent may be allowed to coexist for the purpose of, for example, adjusting the degree of polymerization of the resulting copolymer. Examples of the chain transfer agent include: aldehydes such as acetaldehyde, propionaldehyde, butylaldehyde, and benzaldehyde; ketones such as acetone, methyl ethyl ketone, hexanone, and cyclohexanone; mercaptans such as 2-hydroxyethanethiol; thiocarboxylic acids such as thioacetic acid; halogenated hydrocarbons such as trichloroethylene and perchloroethylene. Among these, aldehydes and ketones are suitably used. The amount of the chain transfer agent to be added is determined depending on the chain transfer constant of the chain transfer agent to be added and on the intended degree of polymerization of the ethylene-vinyl ester copolymer. In general, the amount of the chain transfer agent to be added is desirably 0.1 to 10 mass % with respect to the vinyl ester monomer used.

For the saponification reaction of the ethylene-vinyl ester copolymer, alcoholysis or hydrolysis using a conventionally-known basic catalyst such as sodium hydroxide, potassium hydroxide, or sodium methoxide or a conventionally-known acidic catalyst such as p-toluenesulfonic acid can be employed. Examples of the solvent used in the saponification reaction include: alcohols such as methanol and ethanol; esters such as methyl acetate and ethyl acetate; ketones such as acetone and methyl ethyl ketone; aromatic hydrocarbons such as benzene and toluene; and water. These may be used alone, or two or more thereof may be used in combination. Particularly, it is a simple and preferable practice to use methanol or a mixed solution of methanol and methyl acetate as the solvent and to perform the saponification reaction in the presence of sodium hydroxide serving as a basic catalyst.

The fatty acid derivative used in the present invention only has to contain a fatty acid component as a main component, and may be a modified fatty acid or a fatty acid salt. Conversely, those whose main component is not a fatty acid are excluded. As used herein, the term "main component" means a fatty acid contained in an amount of 50 mass % or more of the total amount of the constituent substances. For example, a fatty acid amide derived from a fatty acid, or a fatty acid ester formed from a fatty acid and an alcohol, can also be suitably used. The fatty acid may be any one selected from a saturated fatty acid, an unsaturated fatty acid, a distilled fatty acid, a hardened fatty acid, and the like. These fatty acids are preferably emulsified or saponified for application onto the paper base. The fatty acid may be a plant fatty acid or an animal fatty acid.

Conventionally, fatty acids have been widely used as fatty acid sizing agents for paper by being cationically modified. The fatty acid sizing agents include those obtained by adding a cationic fixing agent such as a polyamine-based chemical to a fatty acid, a fatty acid salt, or a fatty acid modified for functionalization and those obtained by epoxidizing a fatty acid, a fatty acid salt, or a fatty acid modified for functionalization, with an epichlorohydrin-based chemical. General examples include those obtained by condensation of a fatty acid and a polyamine and those obtained by reaction of an alkenyl succinic acid and a polyamine. Preferable fatty acids are higher aliphatic monocarboxylic acids or polycarboxylic acids having 8 to 30 carbon atoms or particularly preferably 12 to 25 carbon atoms. Examples of the aliphatic carboxylic acids include stearic acid, oleic acid, lauric acid, palmitic acid, arachic acid, behenic acid, tall oil fatty acid, alkyl succinic acid, and alkenyl succinic acid. Examples of the polyamine include: polyalkylene polyamines such as diethylenetriamine, triethylenetetramine, tetraethylenepentamine, pentaethylenehexamine, dipropylenetriamine, and tripropylenetetramine; and aminoethylethanolamine. The product obtained by condensation of the fatty acid and the polyamine is preferably an amide of an amine having three or more amino groups and a higher fatty acid, and examples thereof include a condensation product of a polyethylenepolyamine and a higher fatty acid, and a reaction product of stearic acid and melamine. The condensation product of the fatty acid and the polyamine can be suitably used after being converted to a quaternary salt by means of epichlorohydrin. Alternatively, fatty acid amide waxes, as exemplified by fatty acid amides such as stearylamide and N-substituted fatty acid amides such as N,N'-ethylenebisstearylamide, can also be used as the sizing agent in which a fatty acid is used. Also, a fatty acid-chromium complex salt can be used.

In the present invention, the amount of the fatty acid derivative (B) contained per 100 parts by mass of the ethylene-vinyl alcohol-vinyl ester copolymer (A) is 1 to 100 parts by mass, more preferably 5 to 90 parts by mass, and particularly preferably 10 to 80 parts by mass. If the content of the component (B) is less than 1 part by mass, the reduction in grease resistance when the paper is folded will be large at the folded portion. If the content of the component (B) is more than 100 parts by mass, the grease resistance will be insufficient, and the surface strength of the greaseproof layer will be reduced.

The greaseproof layer of the greaseproof paper of the present invention, which is composed of the ethylene-vinyl alcohol-vinyl ester copolymer (A) and the fatty acid derivative (B), is applied onto at least one surface of a paper base in an amount of 0.5 to 5.0 g/m$^2$, more preferably 0.7 to 4.0 g/m$^2$, particularly preferably 0.8 to 3.0 g/m$^2$, in terms of dry mass. If the applied amount is less than 0.5 g/m$^2$, the resulting grease resistance will be insufficient. If the applied amount is more than 5.0 g/m$^2$, the surface water resistance will be reduced.

The following various additives may be added to the greaseproof layer of the greaseproof paper of the present invention as necessary: a water resistant additive such as glyoxal, a urea resin, a melamine resin, a polyvalent metal salt, or a water-soluble polyamide resin; a plasticizer such as glycol or glycerin; a pH adjuster such as ammonia, sodium hydroxide, sodium carbonate, or phosphoric acid; an antifoaming agent; a release agent; and a surfactant. Furthermore, to the extent that the effects of the present invention are not impaired, the greaseproof layer of the greaseproof paper of the present invention may contain: a water-soluble polymer such as polyvinyl alcohol, vinyl alcohol-vinyl ester copolymer, polyacrylamide, polyacrylic acid, carboxymethyl cellulose, hydroxyethyl cellulose, hydroxymethylpropyl cellulose, casein, or starch (oxidized starch etc.); and/or a synthetic resin emulsion such as a styrene-butadiene copolymer latex, a polyacrylic acid ester emulsion, a polymethacrylic acid ester emulsion, a vinyl acetate-ethylene copolymer emulsion, or a vinyl acetate-acrylic acid ester copolymer emulsion.

The method generally used for providing the greaseproof layer of the present invention on a paper base is a commonly-known method in which, for example, a solution or a dispersion is applied to one or both surfaces of the paper using a device such as a size press, a gate roll coater, or a bar coater. Drying of the coated paper can be done, for example, by a method using hot air, infrared light, a heating cylinder, or a combination thereof. The coated paper having been dried can be subjected to conditioning and calendering to further increase its barrier properties. The preferred conditions for the calendaring are that the roll temperature is room temperature to 100° C. and the roll linear pressure is 20 to 300 kg/cm.

The paper base of the greaseproof paper of the present invention is not particularly limited, and only has to be one having at least one surface on which the greaseproof layer can be provided. Any paper base may be selected depended on the intended use. For example, kraft paper, woodfree paper, paper board, linerboard, glassine paper, parchment paper, or the like, is preferably used. The fibrous raw material of the paper base is not limited to cellulose or cellulose derivatives. Instead of the paper base, a woven fabric, a non-woven fabric or the like composed of fibers made of a material other than cellulose and cellulose derivatives can also be used as a base.

EXAMPLES

Hereinafter, the present invention will be described in more detail with reference to specific examples; however, the present invention is not limited by such examples in any respect. In the examples and comparative examples given below, the "part(s)" and "%" represent "part(s) by mass" and "mass %", respectively, unless otherwise specified.

Example 1

(Production of Ethylene-Vinyl Alcohol-Vinyl Ester Copolymer)

To a 100 L pressure reactor equipped with a stirrer, a nitrogen introduction port, an ethylene introduction port, and an initiator addition port were introduced 36 kg of vinyl acetate and 24 kg of methanol. Then, the temperature was increased to 60° C., after which the system was subjected to nitrogen replacement by nitrogen bubbling for 30 minutes. Subsequently, ethylene was introduced so that the reactor pressure was 0.41 MPa. A 2.0 g/L solution of 2,2'-azobis(4-methoxy-2,4-dimethylvaleronitrile) dissolved as an initiator in methanol was prepared, and subjected to nitrogen replacement by bubbling with nitrogen gas. The internal temperature of the reactor was adjusted to 60° C., and then 68 mL of the initiator solution was injected to initiate polymerization. During the polymerization, the reactor pressure was maintained at 0.41 MPa by introducing ethylene, the polymerization temperature was maintained at 60° C., and the initiator solution was continuously added at a rate of 380 mL/hr. After 5 hours, the polymerization ratio reached 60%, and at this moment the polymerization was stopped by cooling. The reactor was opened to purge ethylene, followed by bubbling with nitrogen gas to complete the ethylene purging. Subsequently, the vinyl acetate monomer remaining unreacted was removed under reduced pressure to obtain a methanol solution of an ethylene-vinyl acetate copolymer. After the solution was adjusted to a concentration of 30%, saponification was carried out by adding a methanol solution of NaOH (having a concentration of 10%) to the solution so that the alkali molar ratio (the number of moles of NaOH/the number of moles of the vinyl acetate units of the ethylene-vinyl acetate copolymer) was 0.03. Thus, an ethylene-vinyl alcohol-vinyl acetate copolymer was obtained. The respective contents of the monomer units, namely, ethylene units, vinyl alcohol units, and vinyl acetate units were 5.5 mol %, 93.9 mol %, and 0.6 mol %, as determined by proton NMR (solvent: DMSO-D6). The above methanol solution of the ethylene-vinyl acetate copolymer was subjected to saponification at an alkali molar ratio of 0.2, and then Soxhlet extraction with methanol was carried out for 3 days, followed by drying to prepare a sample for measurement of the degree of polymerization. The viscosity-average degree of polymerization was 530 as measured by an ordinary method according to JIS K 6726.

(Preparation of Coating Liquid)

An amount of 100 parts by mass of a 15% solution of the ethylene-vinyl alcohol-vinyl ester copolymer obtained above was mixed with 50 parts by mass of a fatty acid derivative, NS-815 manufactured by TOHO Chemical Industry Co., Ltd. (polyethylene polyamine-fatty acid-epichlorohydrin polycondensation product, dry solid mass: 15%) and 75 parts by mass of ion-exchange water to prepare a coating liquid having a dry solid concentration of 10%.

(Fabrication and Test of Coated Paper)

The coating liquid was applied at 50° C. to kraft paper having a basis weight of 64 g/m$^2$ by gate-roll size press coating using a testing gate-roll size press machine (manufactured by Kumagai Riki Kogyo Co., Ltd.). The gate-roll size press coating was performed under the condition of 300 m/minute (applicator roll/inner roll/outer roll=(300 m/minute)/(250 m/minute)/(200 m/minute)). Next, drying was performed using a cylinder rotary dryer at 105° C. for 1 minute. The amount of the coating agent applied was 1.5 g/m$^2$ (on both surfaces) in terms of solid content. The coated paper obtained was subjected to conditioning at 20° C. and 65% RH for 72 hours.

For the coated paper obtained, its grease resistance at an unfolded portion, its grease resistance at a folded portion, and its surface water resistance were measured according to the methods described below. The results are listed in Table 2.

(Grease Resistance at Unfolded Portion)

The grease resistance of the coated surface was measured based on TAPPI No. T 559 cm-02. The measurement was performed by visual judgement.

(Grease Resistance at Folded Portion)

The sample paper was folded double in such a manner that the coated surface faced outwardly. The folded portion was pressed under the conditions of a width of 1.0 mm, a depth of 0.7 mm, and a pressure of 2.5 kgf/cm$^2$·sec to make a clear crease. Thereafter, the sample paper was opened, and its grease resistance at the crease was measured according to TAPPI No. T 559 cm-02. The measurement was performed by visual judgement.

(Surface Water Resistance)

About 0.1 ml of 20° C. ion-exchange water was applied dropwise to the surface of the coated paper, and then the surface was rubbed with a finger tip to inspect the degree of dissolution of the coating agent. The evaluation was made on the following 5-point scale.

5: The surface has excellent water resistance and no sliminess.

4: The surface has some sliminess, but there is no change in the coating layer.

3: A part of the coating agent is emulsified.

2: The whole of the coating agent is emulsified again.

1: The coating agent is dissolved.

Examples 2 to 8

Sheets of coated paper were fabricated in the same manner as in Example 1, except that ethylene-vinyl alcohol-vinyl ester copolymers listed in Table 1 were used as the component (A) of the greaseproof layer, and that the composition and applied amount of the greaseproof layer provided were changed as shown in Table 2. The grease resistance at unfolded portion, the grease resistance at folded portion, and the surface water resistance were measured. The results are listed in Table 2.

Comparative Examples 1 to 9

Sheets of coated paper were fabricated in the same manner as in Example 1, except that the composition and applied amount of the greaseproof layer provided were changed as shown in Table 2. The grease resistance at unfolded portion, the grease resistance at folded portion, and the surface water resistance were measured. The results are listed in Table 2.

TABLE 1

| Component A | Content of ethylene units (mol %) | Content of vinyl alcohol units (mol %) | Content of vinyl acetate units (mol %) | Content of other comonomer units (mol %) | Degree of polymerization |
|---|---|---|---|---|---|
| P-1 | 5.5 | 93.9 | 0.6 | | 530 |
| P-2 | 8.8 | 90.5 | 0.7 | | 520 |
| P-3 | 6.0 | 92.5 | 1.5 | | 1730 |
| P-4 | 2.1 | 90.3 | 6.6 | Itaconic acid; 1.0 | 1750 |
| P-5 | 5.5 | 94.0 | 0.5 | | 250 |
| P-6 | 0.5 | 98.0 | 1.5 | | 1700 |

TABLE 2

| | Composition of greaseproof layer | | | | | | | Evaluation result | | |
|---|---|---|---|---|---|---|---|---|---|---|
| | Component A[a)] | | Component B[b)] | | Other components | | | | | |
| | Type | Content (parts by dry mass) | Type | Content (parts by dry mass) | Type | Content (parts by dry mass) | Applied amount g/m$^2$ | Grease resistance at unfolded portion | Grease resistance at folded portion | Surface water resistance |
| Example 1 | P-1 | 100 | B-1 | 50 | — | — | 1.5 | 8 | 6 | 4 |
| Example 2 | P-1 | 100 | B-1 | 50 | — | — | 4 | 9 | 7 | 5 |
| Example 3 | P-1 | 100 | B-2 | 50 | — | — | 1.5 | 8 | 6 | 4 |
| Example 4 | P-2 | 100 | B-2 | 30 | — | — | 3 | 9 | 7 | 5 |
| Example 5 | P-3 | 100 | B-1 | 75 | — | — | 3 | 8 | 7 | 3 |
| Example 6 | P-4 | 100 | B-1 | 30 | — | — | 3 | 8 | 7 | 5 |
| | | | PAE | 20 | | | | | | |
| Example 7 | P-5 | 100 | B-2 | 50 | — | — | 3 | 7 | 5 | 3 |
| Example 8 | P-6 | 100 | B-2 | 50 | — | — | 3 | 6 | 4 | 4 |
| Comp. Example 1 | P-1 | 100 | — | 0 | — | — | 1.5 | 7 | 2 | 4 |
| Comp. Example 2 | — | — | B-1 | 50 | PVA-105 | 100 | 1.5 | 6 | 1 | 2 |
| Comp. Example 3 | — | — | B-1 | 50 | PVA-117 | 100 | 1.5 | 7 | 2 | 2 |
| Comp. Example 4 | — | — | B-1 | 50 | Modified starch | 100 | 1.5 | 4 | 1 | 1 |
| Comp. Example 5 | — | — | B-1 | 30 | KL-118 | 100 | 3 | 6 | 2 | 4 |
| | | | PAE | 20 | | | | | | |
| Comp. Example 6 | P-1 | 100 | B-1 | 150 | — | — | 1.5 | 4 | 3 | 1 |
| Comp. Example 7 | P-1 | 100 | B-1 | 0.5 | — | — | 1.5 | 7 | 2 | 4 |
| Comp. Example 8 | P-2 | 100 | B-2 | 30 | — | — | 0.3 | 2 | 1 | 4 |
| Comp. Example 9 | P-2 | 100 | B-2 | 30 | — | — | 7 | 9 | 7 | 2 |

[a)]Ethylene-vinyl alcohol-vinyl ester copolymers listed in Table 1

[b)]Fatty acid derivatives

B-1; NS-815 manufactured by TOHO Chemical Industry Co., Ltd. (Polyethylenepolyamine-fatty acid-epichlorohydrin polycondensation product)

B-2; Sequapel 414G manufactured by Omnova Solutions Inc. (Reaction product of stearic acid and melamine)

PAE; Polyamide epichlorohydrin resin, Polycup 172 manufactured by Ashland Inc.

C)

PVA-105; Fully-saponified polyvinyl alcohol, manufactured by KURARAY CO., LTD.

PVA-117; Fully-saponified polyvinyl alcohol, manufactured by KURARAY CO., LTD.

Modified starch; Penford Gum 260, manufactured by Penford Products Co.

KL-118; Carboxylic acid-containing polyvinyl alcohol, manufactured by KURARAY CO., LTD.

[Component (A)]

Example 1 is superior in grease resistance at unfolded portion, grease resistance at folded portion, and surface water resistance to Comparative Examples 2 and 3 using polyvinyl alcohol having no ethylene units and to Comparative Example 4 using modified starch.

In addition, Example 6 is superior in grease resistance at unfolded portion, grease resistance at folded portion, and surface water resistance to Comparative Example 5 containing components different from the component (A) specified in the present invention.

[Component (B)]

Example 1 is superior in grease resistance at unfolded portion and grease resistance at folded portion to Comparative Example 1 containing no component (B).

[Content of Component (B)]

Example 1 is superior in grease resistance at unfolded portion, grease resistance at folded portion, and surface water resistance to Comparative Example 6 in which the content of the component (B) is beyond the upper limit.

In addition, Example 1 is superior in grease resistance at unfolded portion and grease resistance at folded portion to Comparative Example 7 in which the content of the component (B) is below the lower limit.

[Applied Amount]

Example 4 is superior in grease resistance at unfolded portion, grease resistance at folded portion, and surface water resistance to Comparative Example 8 in which the applied amount is below the lower limit.

In addition, Example 4 is superior in surface water resistance to Comparative Example 9 in which the applied amount is beyond the upper limit.

INDUSTRIAL APPLICABILITY

The greaseproof paper obtained by the present invention can, when folded, maintain its grease resistance at the folded portion at a level that does not pose any problem in practical use; therefore, the present invention is useful for providing highly safe greaseproof paper suitable for practical use in packages or containers for various fried food products or fat-containing food products.

The invention claimed is:

1. Greaseproof paper comprising:

a paper base; and a greaseproof layer provided on at least one surface of the paper base, wherein the greaseproof layer comprises an ethylene-vinyl alcohol-vinyl ester copolymer (A) and a fatty acid derivative (B) derived from a fatty acid having 8 or more carbon atoms, comprises from 50 to 90 parts by mass of the fatty acid derivative (B) per 100 parts by mass of the ethylene-vinyl alcohol-vinyl ester copolymer (A), and is in an amount of 0.5 to 5.0 g/m$^2$ in terms of dry mass, wherein the ethylene-vinyl alcohol-vinyl ester copolymer (A) has a content of ethylene units of 0.1 to 13 mol %, a content of vinyl ester units of 0.1 to 10 mol %, a content of vinyl alcohol units of 87 to 98 mol %, and a degree of polymerization of 300 to 2000, wherein the fatty acid derivative (B) is a fatty acid amide compound or a fatty acid ester compound, wherein the fatty acid amide compound is a condensation product of (i) the fatty acid having 8 or more carbon atoms and (ii) a polyalkylene polyamine or aminoethylethanolamine, and wherein the greaseproof layer does not comprise a starch.

2. The greaseproof paper according to claim 1, wherein the ethylene-vinyl alcohol-vinyl ester copolymer (A) has a content of ethylene units of 3 to 10 mol %, has a total content of vinyl alcohol units and vinyl ester units of 90 to 97 mol %, and has a degree of polymerization of 400 to 1800.

3. The greaseproof paper according to claim 1, wherein the fatty acid derivative (B) is a fatty acid amide compound.

4. The greaseproof paper according to claim 3, wherein the fatty acid derivative (B) is an amide of an amine having three or more amino groups and a higher fatty acid.

* * * * *